US005755521A

United States Patent [19]

Ito et al.

[11] Patent Number: 5,755,521

[45] Date of Patent: *May 26, 1998

[54] PRINTER AND METHOD FOR CONTROLLING THE SAME

[75] Inventors: Yoshikazu Ito; Masahiro Minowa; Mitsuaki Teradaira; Kazunari Yawata, all of Nagano, Japan

[73] Assignee: Seiko Epson Corporation, Tokyo, Japan

[ * ] Notice: The term of this patent shall not extend beyond the expiration date of Pat. No. 5,584,590.

[21] Appl. No.: 742,491

[22] Filed: Nov. 1, 1996

Related U.S. Application Data

[63] Continuation of Ser. No. 44,504, Apr. 9, 1993, Pat. No. 5,584,590, which is a continuation-in-part of Ser. No. 791, 286, Nov. 13, 1991, Pat. No. 5,214,750.

[30] Foreign Application Priority Data

| | | | |
|---|---|---|---|
| Nov. 14, 1990 | [JP] | Japan | 2-307861 |
| Sep. 27, 1991 | [JP] | Japan | 3-249178 |
| Apr. 27, 1992 | [JP] | Japan | 4-108041 |
| Feb. 9, 1993 | [JP] | Japan | 5-21417 |

[51] Int. Cl.[6] ..... B41J 11/50

[52] U.S. Cl. ..... 400/605; 400/578

[58] Field of Search ..... 400/605, 708, 400/625, 555, 568, 582, 578

[56] References Cited

U.S. PATENT DOCUMENTS

| | | | |
|---|---|---|---|
| 4,473,314 | 9/1984 | Imaizumi | 400/629 |
| 4,475,731 | 10/1984 | Wood | 400/629 |
| 4,615,630 | 10/1986 | Maeshima | 400/608.3 |
| 4,663,722 | 5/1987 | Sato | 400/605 |
| 4,756,636 | 7/1988 | Maruyama et al. | 400/605 |
| 4,847,633 | 7/1989 | Piatt et al. | 400/134 |
| 4,875,790 | 10/1989 | Karube et al. | 400/605 |
| 4,915,525 | 4/1990 | Hosoi | 400/605 |
| 5,061,095 | 10/1991 | Asai et al. | 400/56 |
| 5,071,273 | 12/1991 | Kato | 400/708 |
| 5,080,513 | 1/1992 | Clary | 400/605 |
| 5,214,750 | 5/1993 | Minowa et al. | 400/605 |
| 5,398,305 | 3/1995 | Yawata et al. | 395/115 |
| 5,428,714 | 6/1995 | Yawata et al. | 395/112 |
| 5,584,590 | 12/1996 | Ito et al. | 400/605 |

FOREIGN PATENT DOCUMENTS

| | | | |
|---|---|---|---|
| 0428163 | 5/1991 | European Pat. Off. | 395/111 |
| 3211843 | 10/1983 | Germany | 395/111 |
| 132360 | 6/1986 | Japan | 400/555 |
| 14069 | 1/1989 | Japan | 400/555 |

*Primary Examiner*—Edgar S. Burr
*Assistant Examiner*—Steven S. Kelley
*Attorney, Agent, or Firm*—Sughrue, Mion, Zinn, Macpeak & Seas, PLLC

[57] ABSTRACT

A printer which includes a paper selector for setting return amount and return amount memories for storing return amounts for at least two kinds of recording paper. The type of recording paper is selected by a printer control command so that a return amount for continuing a printing operation specific to the selected type of recording paper can be set. As a result, printing can be executed once a return amount has been set for each type of recording paper if the user wishes to print on different types of recording paper having different return amounts, thereby reducing the burden on the part of the host computer in controlling the printer and increasing the printing speed of the printer.

9 Claims, 7 Drawing Sheets

PRINTER AND METHOD FOR CONTROLLING THE SAME

This is a continuation of application Ser. No. 08/044.504 filed Apr. 9, 1993 now U.S. Pat No. 5.584.590, which is a continuation-in-part of application Ser. No. 07/791.286, filed Nov. 13, 1991, now U.S. Pat. No. 5.214.750.

BACKGROUND OF THE INVENTION

The present invention relates to printers which are connected to a host computer through a transmission line such that a printing operation is performed based upon control commands received from the host computer. More particularly, the present invention is directed to a POS printer capable of transferring at least two types of recording paper.

Conventional printers capable of printing on at least two types of recording paper include only one memory for storing a value corresponding to the amount of return required to transfer the recording paper for printing on successive lines of the recording paper. Once a return amount has been set, such return amount is applied to all types of recording paper supplied to the printers.

Therefore, conventional printers involve the operation of setting a return amount every time the type of recording paper is changed when the return amount is different from one type of recording paper to another. Therefore, the burden on the part of the host computer which is responsible for controlling the printer is increased, and the printing speed of the printer is decreased since the host computer must transmit a control command for setting a return amount for each type of recording paper supplied to the printer.

SUMMARY OF THE INVENTION

The present invention has been designed to overcome the above problems. Accordingly, an object of the present invention is to provide a printer capable of setting a return amount corresponding to the type of recording paper for at least two types of recording paper and to provide for the selection of the type of recording paper for which to set a return amount, as well as a method for controlling the printer.

A printer according to the present invention includes a recording paper transfer mechanism for independently transferring at least two types of recording paper and a printing mechanism for printing on at least the two types of recording paper and provides for the setting of a return amount specific to the type of recording paper selected.

A method for controlling the printer involves the steps of selecting the type of recording paper for which to set a return amount and storing the return amount in a return amount memory. The printing operation for a selected recording paper includes the steps of transferring the selected recording paper to the printing position by the recording paper transfer mechanism, driving the print head to perform the printing operation, executing a return operation based upon the return amount corresponding to the selected recording paper, and repeating the above-mentioned steps until the printing operation is complete.

According to the above construction, the return amount can be set for each type of recording paper and the type of recording paper for which to set a return amount can be selected, thereby reducing the burden on the part of the host computer that controls the printer. In addition, the printing speed of the printer is increased since the host computer does not have to transmit a control command for setting a return amount for each printing operation performed with a different type of-recording paper.

DESCRIPTION OF THE PREFERRED EMBODIMENT

A printer constructed according to a preferred embodiment of the invention will now be described.

Figure 3:
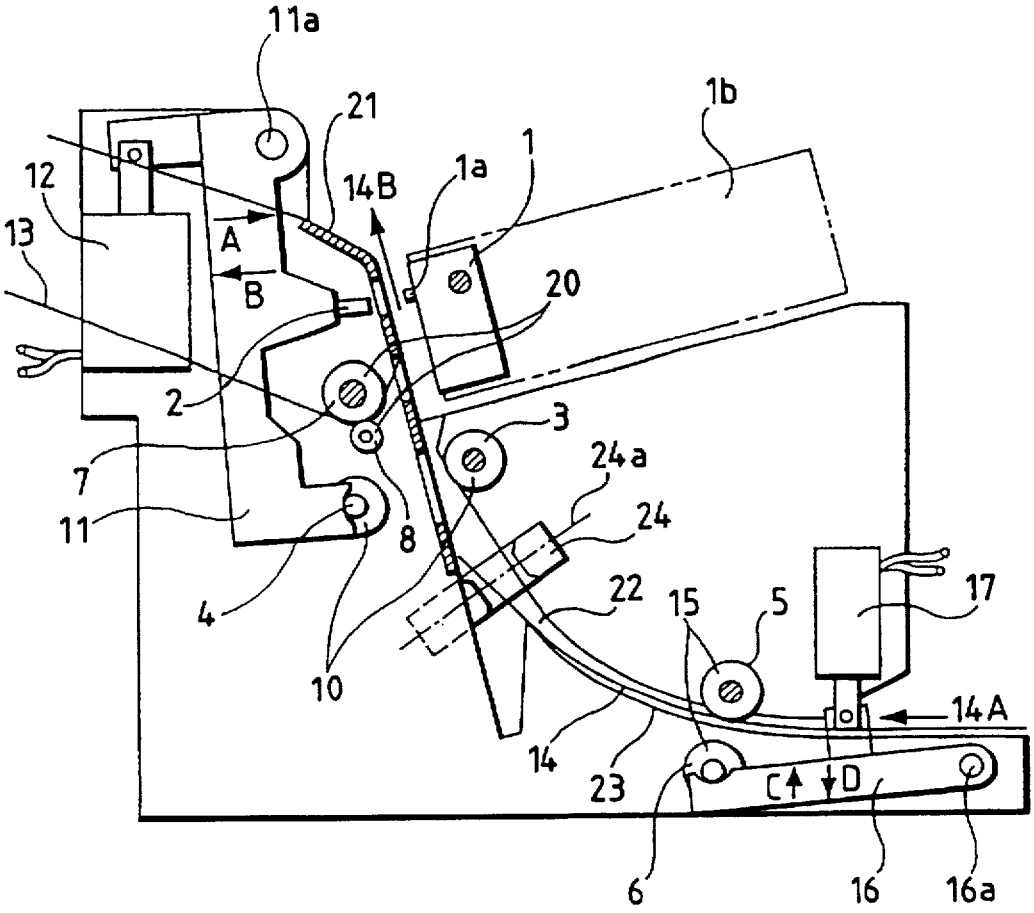
FIG. 3 is a schematic diagram illustrating the construction of a printing mechanism and a recording paper transferring mechanism according to the present invention, as well as an operation of the respective mechanical parts thereof in accordance with the type of recording paper.

FIG. 3 is a schematic diagram illustrating the construction of a printing mechanism and a recording paper transfer mechanism of the printer according to the present invention, which is capable of printing on at least two types of recording paper, i.e., continuous paper and slip paper, and is able to transfer each type of paper independently. FIG. 3 also illustrates the operation of the respective mechanical parts depending upon the type of paper selected.

Reference numeral 1 designates a print head which includes printing wire pins la and an ink ribbon lb. Printing is carried out on a sheet of continuous paper 13 or a sheet of slip paper 14 that is held between the printing wire pins la and a platen 2.

Reference numeral 3 designates a drive roller for transferring the slip paper 14. A slip paper hold roller 4 is arranged on an arm 11 and located at a position confronting the drive roller 3 and is moved by the arm 11. The platen 2 is similarly fixed on the arm 11. The arm 11 is rotatable in both directions illustrated by arrows A and B around a supporting point 11a by a plunger 12. A printing part opening/closing mechanism is composed mainly of the platen 2, the arm 11, and the plunger 12. Further, a transfer part opening/closing mechanism is composed mainly of the slip paper hold roller 4, the arm 11, and the plunger 12. A slip paper transfer mechanism 10 is composed mainly of the same components as the transfer part opening/closing mechanism and the drive roller 3. The printing part opening/closing mechanism is designed to change the distance between the print head 1 of the printing mechanism and the platen 2. The printing part opening/closing mechanism and the transfer part opening/closing mechanism share in common a drive source and the arm 11, which serves as a transmission member.

Reference numeral 5 designates a drive roller which confronts a slip paper hold roller 6. The slip paper hold roller 6 is arranged on arm 16 which is rotatable in the m directions indicated by arrows C and D around a supporting point 16*a* by a plunger 17. A slip paper transfer mechanism 15 is composed mainly of the drive roller 5, the slip paper hold roller 6, the arm 16, and the plunger 17. Reference numeral 23 designates a slip paper guide forming a slip paper transfer passage 22.

A slip paper detector 24 illustrated as an optical sensor of an opposed arrangement type having an optical axis 24*a*, detects the presence or absence of the slip paper 14 depending upon whether or not the optical axis 24*a* is shut off.

A step motor is generally used as a drive source for transferring the slip paper 14. The slip paper transfer mechanisms 10, 15 are connected to the same drive source. When rotation of the motor (not shown) is transmitted to the drive rollers 3, 5 by a power transmission mechanism (not shown) constituted by a transmission system such as gears, a sheet of slip paper 14 is held between the drive rollers 3, 5 and the slip paper hold rollers 4, 6 confronting such drive rollers. The slip paper 14 is printed and transferred through a section indicated by arrows 14A to 14B as a slip paper passage.

A sheet of continuous paper 13 is transported forward via the drive roller 7 passing through the interior of the arm 11 supporting the platen 2 from a continuous paper supply part (not shown) located outside. This arrangement serves as a continuous paper passage. Therafter, the paper passes over a paper guide 21. Reference numeral 8 designates a continuous paper hold roller confronting the drive roller 7. A continuous paper transfer mechanism 20 is composed mainly of the driver roller 7 and the continuous paper hold roller 8. A drive source of the drive roller 7 is connected to the same source as the slip paper transfer mechanisms 10, 15. The drive roller 7 is designed to be controlled by the power transmission mechanism (not shown).

Figure 2:
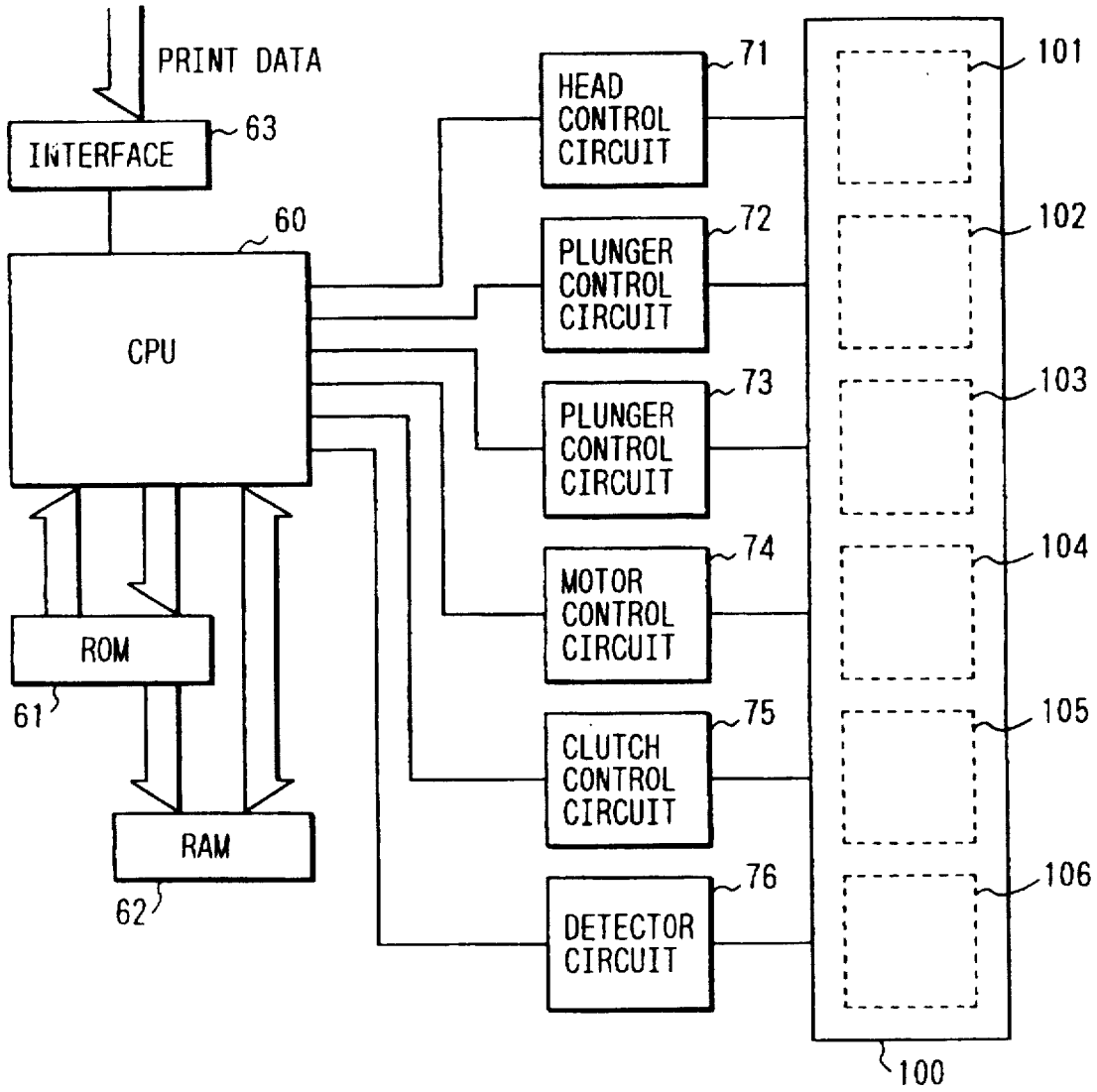
FIG. 2 is a control block diagram illustrating the general configuration of the printer according to the present invention.

FIG. 2 is a control block diagram illustrating the general configuration of the present invention. Reference numeral 100 designates a printer mechanism previously described with reference to FIG. 3. The printer mechanism includes a print head 101, a printing part opening/closing mechanism that also serves as a transfer opening/closing mechanism 102, a transfer opening/closing mechanism 103, a motor 104 serving as a power source for transferring the continuous paper 13 and the slip paper 14, a power transmission mechanism 105 for transmitting the power of the motor 104 to the drive rollers 3, 5, 7, and a slip paper detector 106. The printer mechanism also includes a CPU 60, a ROM 61 for storing programs for controlling the printer, and a RAM 62 used for temporary storage and for storing return amounts for both the continuous paper 13 and the slip paper 14. The printer mechanism further includes an interface 63, a head control circuit 71, a first plunger control circuit 72, a second plunger control circuit 73, a motor control circuit 74, a clutch control circuit 75, and a detector circuit 76 connected to a slip paper detector 106 for detecting the presence or absence of a sheet of slip paper 14.

Upon input of printing data from the interface 63, the printing data is temporarily stored in the RAM 62. The CPU analyzes the data, reads the character font data corresponding to the data code, and executes a printing operation by controlling the printer mechanism through the motor control circuit 74, the head control circuit 71, and one of the first and second plunger control circuits 72, 73.

Figure 1:
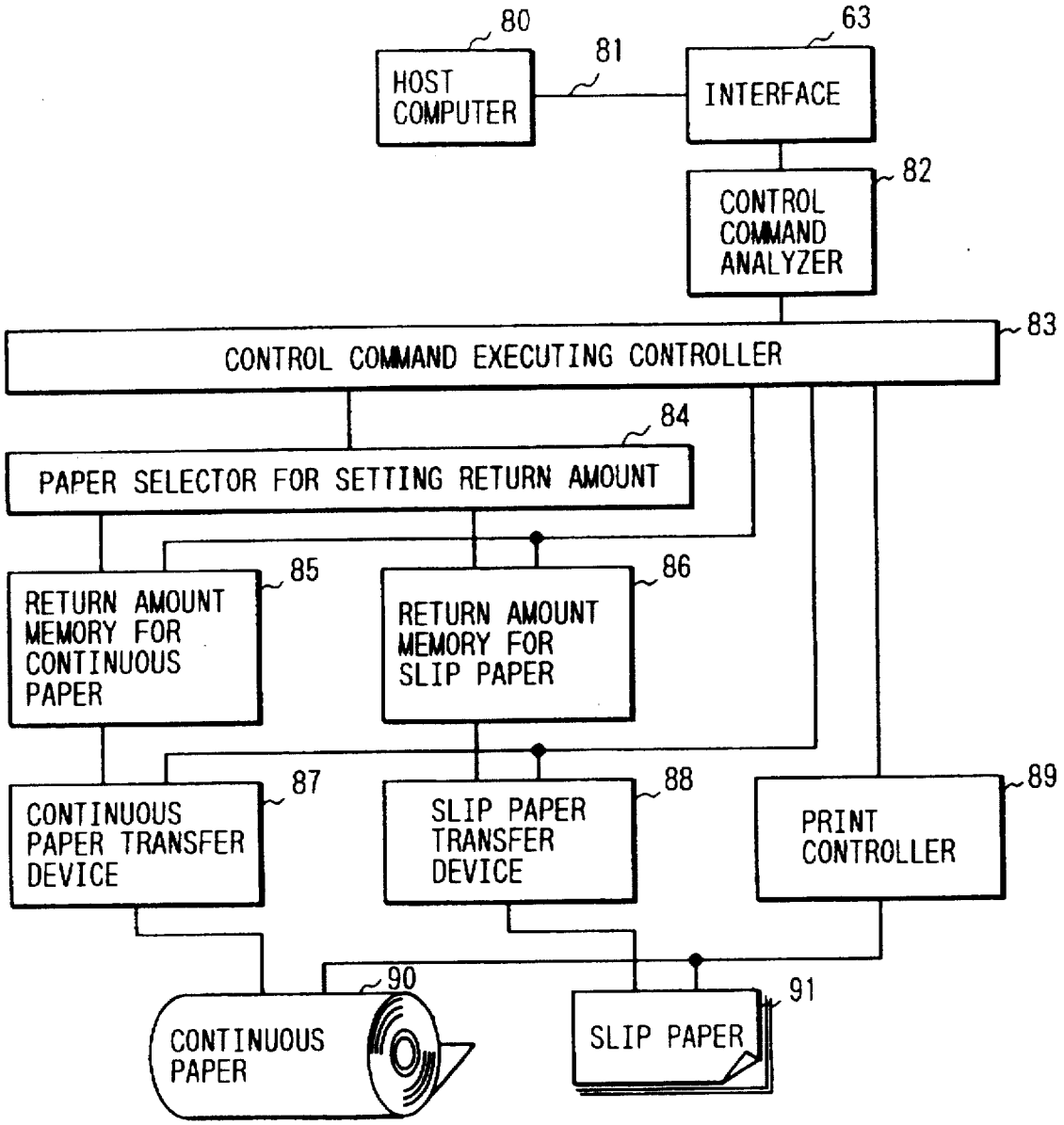
FIG. 1 is a functional diagram illustrating the construction of the printer according to the present invention.

FIG. 1 is a functional diagram illustrating the present invention.

A control command supplied to the interface 63 from a host computer 80 via a transmission line 81 is analyzed by a control command analyzer 82, and the execution of the analyzed control command is initiated by a control command executing controller 83. The control command executing controller 83 controls, in accordance with the control command, a paper selector 84 for setting return amount which represents the amount of lines which are fed by the feeding motor when the return operation is executed. In addition, the control command executing controller 83 controls a return amount memory 85 for continuous paper for storing a return amount to be set for the continuous paper 90 when the continuous paper is selected by the paper selector 84, and a return amount memory 86 for slip paper for storing a return amount to be set for the slip paper 91 when the slip paper is selected by the paper selector 84.

A continuous paper transfer device 87 is provided for transferring the continuous paper 90 by controlling the continuous paper transfer mechanism 20 based upon the return amount set at the return amount memory 85 for the continuous paper. A slip paper transfer device 88 is provided for transferring the slip paper 91 by controlling the slip paper transfer mechanisms 10, 15 based upon the return amount set at the return amount memory 86 for slip paper. The continuous paper transfer device 87, the slip paper transfer device 88, and a print controller 89 including the print head 1 and the platen 2 for printing on the continuous paper 90 and the slip paper 91 are each controlled by the control command executing controller 83.

Practical operation is described as follows with reference to FIGS. 1 and 2 CPU 60 performs as control command analyzer 82, control command executing controller 83 and paper selector for setting return amount 84 in cooperation with ROM 61 and RAM 62. Return amount memories (85, 86) are realized by CPU 60 and RAM 62. Continuous paper transfer device 87 is realized by plunger control device 72, transfer opening/closing mechanism 102, motor control circuit 74 and motor 104. Slip paper transfer device 88 is realized by plunger control circuit 74, 73,transfer opening/closing mechanisms 102,103, motor control circuit 74 and motor 104. Print controller 89 is realized by head control circuit 71 and print head 101.

Figure 4:
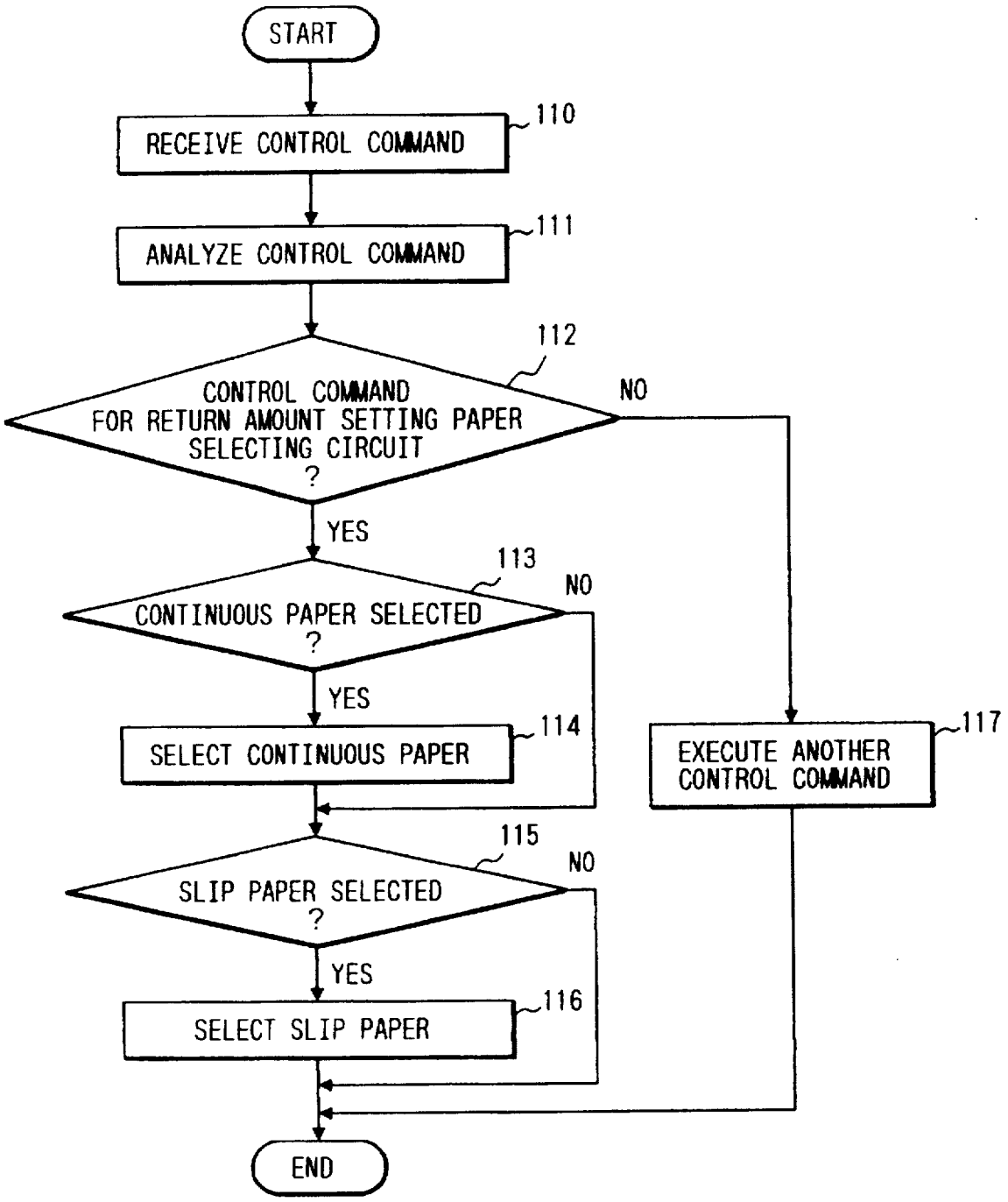
FIG. 4 is a flowchart illustrating the operation performed by the printer according to the present invention when a control command for controlling the return amount setting paper selecting means is received.

FIG. 4 is a flowchart providing an illustrative example of the operation performed when the printer has received a control command for controlling the paper selector 84.

Upon reception of a control command by the interface 63 (Step 110), the control command analyzer 82 analyzes the received control command (Step 111). If the analyzed control command includes information for controlling the paper selector 84 (Step 112), and if the control command designates the continuous paper as the type of return amount setting paper (Step 113), then the continuous paper is selected as the return amount setting paper (Step 114). If the control command designates the slip paper as the type of return amount setting paper (Step 115), then the slip paper is selected as the return amount setting paper (Step 116).

If the control command analyzed by the control command analyzer 82 does not include information for controlling the paper selector 84 (Step 112), another control command is executed (Step 117).

Figure 5:
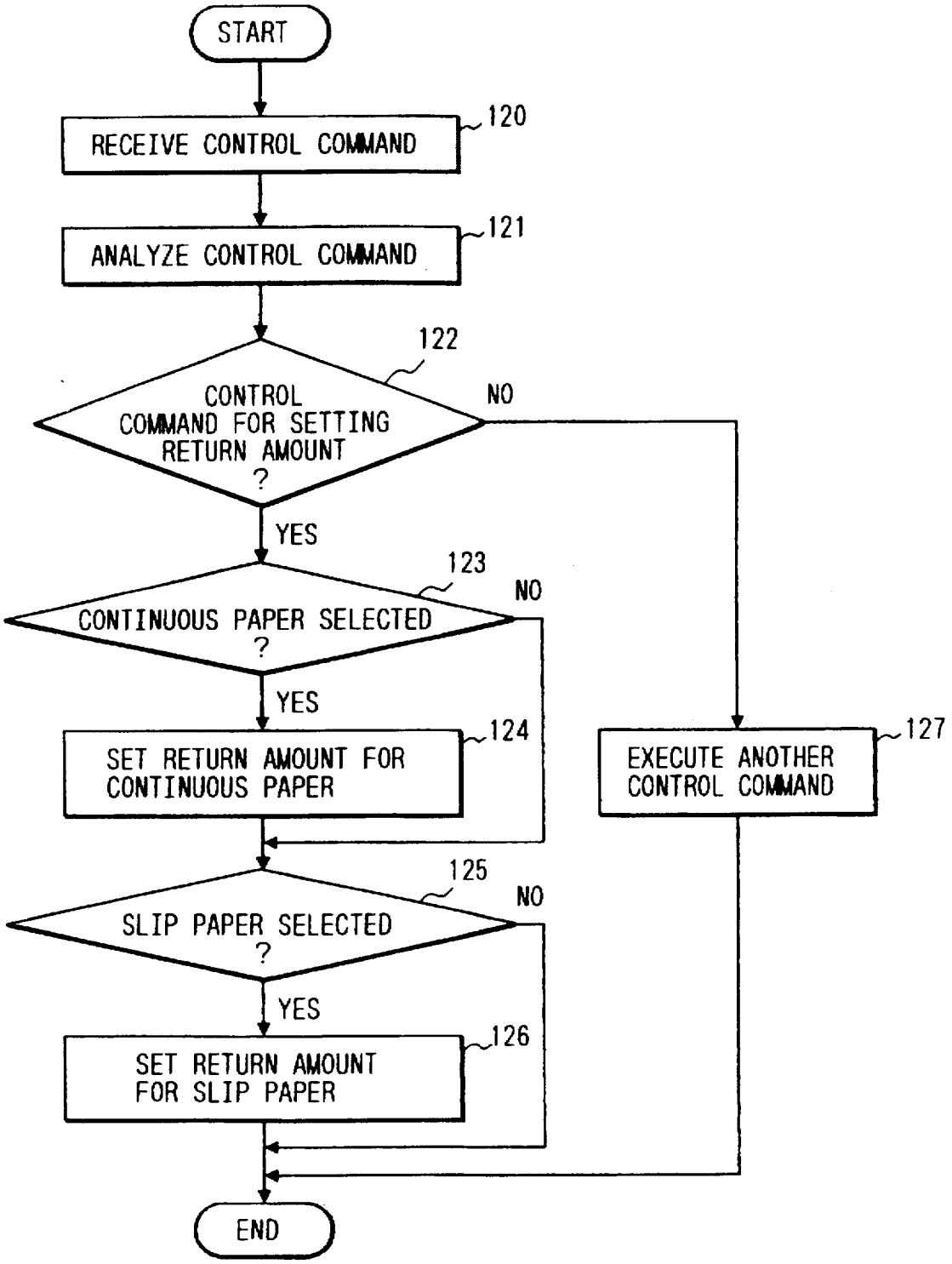
FIG. 5 is a flowchart illustrating the operation performed by the printer according to the present invention when a control command for setting a return amount is received.

FIG. 5 is a flowchart providing an illustrative example of the operation performed when the printer has received a control command for setting a return amount.

Upon reception of a control command by the interface 63 (Step 120), the control command is analyzed by the control command analyzer 82 (Step 121). When the control command includes information for setting a return amount (Step 122), and if the continuous paper is selected as the type of paper for which to set a return amount by the paper selector 84 (Step 123), then a return amount set for the continuous paper is stored in the return amount memory 85 for the continuous paper (Step 124). If the slip paper is selected as the type of paper for which to set a return amount by the paper selector 84 (Step 125), then a return amount set for the slip paper is stored in the return amount memory 86 for the slip paper (Step 126).

If the control command analyzed by the control command analyzer 82 does not include information for setting a return amount (Step 122), then another control command is executed (Step 127).

Figure 6:
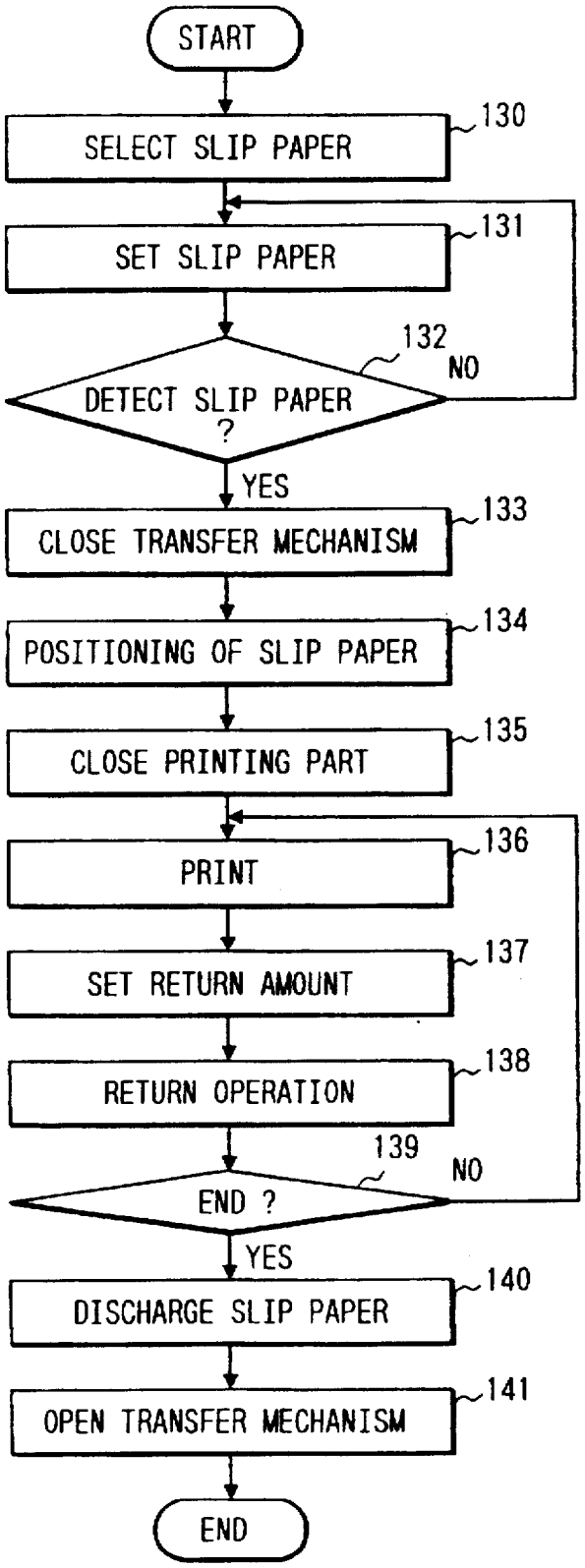
FIG. 6 is a flowchart illustrating the operation performed by the printer according to the present invention when a sheet of slip paper is printed and returned.

FIG. 6 is a flowchart providing an illustrative example of the operation performed when the printer prints on the slip paper.

When the slip paper is selected as the recording paper by executing a control command and operating switches of the printer, etc., the plungers 12, 17 are deenergized, causing the slip paper transfer mechanisms 10, 15 and the printing part opening/closing mechanism to be opened to prepare the printer to receive a sheet of slip paper 14 (Step 130). The sheet of slip paper 14 is then positioned at a form stopper (not shown) (Step 131). When the slip paper 14 has been set in place, the optical axis 24*a* of the slip paper detector 24 is shut off so that the presence of the slip paper is detected (Step 132). Such detection then causes the plunger 17 to be energized, the slip paper transfer mechanism 15 to be closed, and the slip paper 14 to be held between the drive roller 5 and the slip paper hold roller 6 (Step 133). Then, the motor (not shown) is driven so that the slip paper 14 is transferred, along the paper guide 23, to a position past a front end of the printing part that is in an open state, thereby completing the positioning (Step 134) of the slip paper 14.

When the plunger 12 has been energized thereafter, the printing part opening/closing mechanism is closed, causing the platen 2 to be set to a printable position and preparing the printer for a printing operation (Step 135). The slip paper transfer mechanism 10 is closed simultaneously with the printing part opening/closing mechanism. Then, based upon the control command, printing is executed by driving the print head 1 (Step 136). Further, based upon the return amount of the slip paper set in the return amount memory 86 for the slip paper (Step 137), the driving force of the motor (not shown) is transmitted only to the drive rollers 3, 5 but not to the drive roller 7 by the power transmission mechanism (not shown), so that only the slip paper 14 is transferred in the direction of the arrow 14A and the printer executes a return operation (Step 138).

The printing and returning operation is repeated (Step 139), and when such repetition has been completed, the slip paper 14 is discharged in the direction of the arrow 14B while transmitting the drive force of the motor (not shown) only to the drive rollers 3, 5 but not to the drive roller 7 by the power transmission mechanism (not shown) (Step 140). The plungers 12, 17 are then deenergized, so that the slip paper transfer mechanism is opened (Step 141) to thereby complete a series of printing operations on the slip paper 14.

Figure 7:
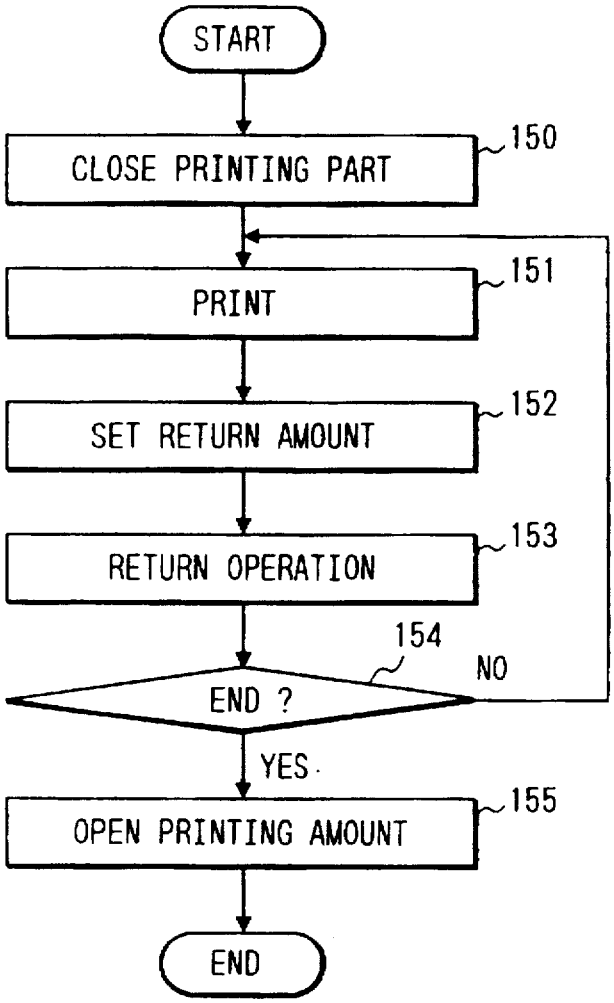
FIG. 7 is a flowchart illustrating the operation performed by the printer according to the present invention when a sheet of continuous paper is printed and returned.

FIG. 7 is a flowchart illustrating the operation performed when the printer prints on the continuous paper 13.

When the plunger 12 is energized with the continuous paper 13 being held on the drive roller 7 and set while passing between the platen 2 and the print head 1, the printing part opening/closing mechanism is closed to prepare the printer for printing, with the platen 2 being set to a printable position (Step 150). Then, based on a control command, printing is started by the operation of the print head 1 (Step 151) and based on the return amount set for the continuous paper in the return amount memory 85 for the continuous paper (Step 152), the drive force of the motor (not shown) is transmitted to the drive roller 7 by the power transmission mechanism to transfer the continuous paper 13 and execute a return operation (Step 153).

The printing and returning operation is repeated (Step 154), and when such repetition has been completed, the plunger 12 is deenergized and the printing part opening/closing mechanism is opened (Step 155).

Figure 8:
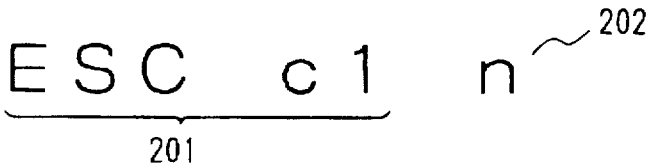
FIG. 8 is a diagram illustrative of an embodiment of a control command used in the present invention.

FIG. 8 is a diagram illustrative of an example of the control command to be used in the present invention. The control command designates the paper for which to set a return amount. A code, "ESC c1" 201, indicates the type of control command. When this code is read by the control command analyzer, the control command analyzer interprets that the control command is directed to selecting the type of paper for which to set a return amount. A code, "n" 202, indicates a code of the type of recording paper for which to set a return amount. The code is expressed in, e.g., hexadecimal, with 1H indicating the continuous paper, 10 H, the slip paper, and 11H, both the continuous paper and the slip paper. When such a code is set, the type of recording paper corresponding to the set code is selected.

The default value is, e.g., 11 H, allowing both the continuous paper and the slip paper to be selected as the paper for which return amounts are set.

Specifically, "ESC" represent corresponding ASCII code, i.e. "1BH" where "H" is a hexadecimal indicator. "c1", which is a pair of characters, also represents corresponding ASCII codes, i.e. "63H" and "31H". Therefore, if the parameter code "n" is "01H", the return amount for the continuous paper is to be set, the whole code being "1 BH 63H 31H 01H".

As described above, the return amount setting procedure is completed by executing a pair of commands, namely a command for selecting the media type and a command for setting the return amount. "ESC c1 (n)" is an example of the former command. As example of latter command, "ESC 3 (n)" is provided. This command is used for setting the line spacing to n/240 of an inch. If the return amount should be set to ⅙ inch, "n" should be 40 (28 in hexadecimal). In this case, the command code is decided as "1BH 33H 28H". Therefore, if the return amount for the continuous paper should be set to ⅙, then the whole code which should be sent to the printer should be "1BH 63H 31H 01H 1BH 33H 28H".

As set forth in the foregoing description, the printer according to the present invention provides for the selection of the type of recording paper by a printer control command so that a return amount can be set by the type of recording paper selected. As a result, printing can be executed once a return amount has been set for each type of recording paper if the user wishes to print on different types of recording paper having different return amounts, respectively, thereby reducing the burden on the part of the host computer in controlling the printer. In addition, the printing speed of the printer is increased, since the host computer does not have to transmit a control command for setting a return amount for each printing operation performed with a different type of recording paper.

What is claimed is:

1. A printing apparatus having control command analyzing means for receiving data from a host device and then interpreting the data including print data and control commands for controlling a printing operation, and capable of printing on at least two types of recording media, said printing apparatus comprising:

a plurality of memory means provided corresponding to each of said at least two types of recording media for storing respective return amount values;

a plurality of recording medium transfer means provided corresponding to each of said at least two types of recording media, each of said recording medium transfer means independently transferring said corresponding type of recording medium based on said respective return amount value stored in a respective one of said plurality of memory means after one line printing on said corresponding type of recording medium has been performed;

recording medium transfer selection means for selecting one of said plurality of recording medium transfer means to be used for printing in accordance with a first predetermined control command interpreted by said command analyzing means;

recording medium selection means for selecting one or more of said at least two types of recording media in accordance with a second predetermined control command interpreted by said control command analyzing means; and return amount determination means for determining and then storing in said respective memory means said respective return amount value(s) corresponding to said one or more of said at least two types of recording media selected by said recording medium selection means.

2. A printing apparatus according to claim 1, wherein said return amount determination means comprises:

means for determining said return amount value in accordance with a third predetermined control command interpreted by said control command analyzing means.

3. A method for controlling a printing apparatus capable of printing on at least two types of recording media, comprising the steps of:

(a) storing return amount values corresponding to said at least two types of recording media;

(b) receiving from a host device control commands for controlling a printing operation;

(c) interpreting said control commands received in step (b);

(d) selecting one or more of said at least two types of recording media in accordance with a first predetermined control command interpreted in step (c);

(e) updating said return amount value(s) stored in step (a) corresponding to said one or more of said at least two types of recording media selected in step (d);

(f) selecting one of said at least two types of recording media in accordance with a second predetermined control command interpreted in step (c);

(g) performing one line printing on said one of said at least two types of recording media selected in step (f); and (h) transferring after step (g) said one of said at least two types of recording media selected in step (f) based on said corresponding return amount value.

4. The method according to claim 3, wherein step (e) comprises the steps of:

(e1) determining said return amount value in accordance with a third predetermined control command interpreted in step (c); and (e2) replacing said return amount value(s) stored in step (a) corresponding to said one or more of said at least two types of recording media selected in step (d) with the return amount value determined in step (e1).

5. A method for controlling a printing apparatus capable of printing on at least two types of recording media, comprising the steps of:

(a) receiving from a host device a first predetermined control command for designating a recording media to be controlled;

(b) interpreting said first predetermined control command received in step (a);

(c) selecting one of said at least two types of recording media to be controlled in accordance with said first predetermined control command interpreted in step (b);

(d) controlling said one of said at least two types of recording media selected in step (c);

(e) storing control values, each of said control values being used in step (d) for controlling a respective one of said at least two types of recording media;

(f) receiving from the host device a second predetermined control command for designating a recording media the control value(s) for which is updated;

(g) interpreting said second predetermined control command received in step (f);

(h) selecting one or more of said at least two types of recording media in accordance with said second predetermined control command interpreted in step (g); and (j) updating said control value(s) stored in step (e) corresponding to said one or more of said at least two types of recording media selected in step (h).

6. The method according to claim 5, wherein step (j) comprises the steps of:

(j1) receiving from the host device a third predetermined control command for setting the control value(s);

(j2) interpreting said third predetermined control command received in step (j1);

(j3 ) determining said control value in accordance with said third predetermined control command interpreted in step (j2); and (j4 ) replacing said control value(s) stored in step (e) corresponding to said one or more of said at least two types of recording media selected in step (h) with the control value(s) determined in step (j3).

7. The method according to claim 6, wherein said control value is a return amount value representing an amount by which said recording medium must be transferred between printing operations on successive lines.

8. A printing apparatus having control command analyzer which receives from a host device data including print data and control commands for controlling a printing operation and then interprets the data, and capable of printing on at least two types of recording media, said printing apparatus comprising:

a plurality of memories provided corresponding to each of said at least two types of recording media for storing respective return amount values;

a plurality of recording medium transfer mechanisms provided corresponding to each of said at least two types of recording media, each of said recording medium transfer mechanisms independently transferring said corresponding type of recording medium based on said respective return amount value stored in a respective one of said plurality of memories after one line of printing on said corresponding type of recording medium has been performed;

a recording medium transfer selector which selects one of said plurality of recording medium transfer mechanisms to be used for printing in accordance with a first predetermined control command interpreted by said command analyzer;

a recording medium selector which selects one or more of said at least two types of recording media in accordance with a second predetermined control command interpreted by said control command analyzer; and a return amount determination section which determines and then stores in said respective memories said respective return amount value(s) corresponding to said one or more of said at least two types of recording media selected by said recording medium selector.

9. A printing apparatus according to claim 8 wherein said return amount determination section determines said return amount value in accordance with a third predetermined control command interpreted by said control command analyzer.

* * * * *